United States Patent [19]

Martine

[11] 4,325,204

[45] Apr. 20, 1982

[54] DOOR CONSTRUCTION

[76] Inventor: Walter I. Martine, 19767 Reedview Dr., Rowland Heights, Calif. 91748

[21] Appl. No.: 110,847

[22] Filed: Jan. 10, 1980

[51] Int. Cl.[3] ..... E05F 15/06

[52] U.S. Cl. ..... 49/372; 49/504; 49/409

[58] Field of Search ..... 49/372, 409, 410, 411, 49/380, 504; 16/94 R, 96 R

[56] References Cited

U.S. PATENT DOCUMENTS

| | | | |
|---|---|---|---|
| 929,633 | 7/1909 | Schuyler et al. | 49/372 X |
| 1,221,766 | 4/1917 | Pitcher | 49/380 X |
| 2,732,919 | 1/1956 | Johnson, Jr. | 49/372 |
| 3,068,970 | 12/1962 | Neal | 49/504 X |
| 3,299,592 | 1/1967 | Cable | 49/504 X |
| 3,327,428 | 6/1967 | Horton et al. | 49/409 X |

*Primary Examiner*—Kenneth Downey
*Attorney, Agent, or Firm*—Boniard I. Brown

[57] ABSTRACT

A pocket door assembly including a header structure which comprises a first element which is generally planar and generally horizontal. Second, third, fourth and fifth elements are each generally planar and each depend from the first element in sequential generally parallel spaced relationship. A roller support channel has a generally J-shaped cross section. The roller support channel depends from the first element. A door is generally planar and a plurality of rollers extend upwards beyond the top of the door. The rollers are spaced a predetermined distance apart. The second and third elements include a plurality of slots spaced the predetermined distance apart and allow passage of the rollers into the roller support channel.

11 Claims, 7 Drawing Figures

DOOR CONSTRUCTION

BACKGROUND OF THE INVENTION

The invention relates to construction products and particularly to sliding door assemblies. There has been considerable commercial interest in so called "pocket" door assemblies. Such assemblies provide a pocket within the wall of a building to accomodate the door when it is in the open position. In the prior art construction techniques the assemblies have often been fabricated at the construction site. Such construction techniques require the use of relatively high paid skilled labor. Fabrication at the construction site has the further disadvantage that the advantages of increased productivity and improved quality control can not be attained in the manner in which it is possible with mass production.

It is a primary object of the invention to provide apparatus which will facilitate rapid installation of such assemblies.

It is another object of the invention to provide apparatus which will reduce total construction costs.

It is another object of the invention to provide apparatus which may be readily prefabricated.

Still another object of the invention is to provide apparatus which will have an attractive appearance.

SUMMARY OF THE INVENTION

A pocket door assembly including a header structure which comprises a first element which is generally planar and generally horizontal. Second, third, fourth and fifth elements are each generally planar and each extend downward from the first element in sequentially generally parallel spaced relationship. A roller support channel is generally J-shaped and depends from the first element. A door assembly includes a generally planar door and a plurality of rollers extending upwards beyond the top of the door. The rollers are spaced a predetermined distance apart. The second and third elements include a plurality of slots spaced the predetermined distance apart and allow passage of the rollers into the roller support channel.

In one form of the invention the first element may further include first and second pairs of depending spaced ribs. The first pair of the depending spaced ribs may engage the sides of the third element and the second pair of ribs may engage the sides of the fourth element. In one form of the invention the first, second and fifth elements and the ribs may each be part of a single channel.

In other forms of the invention the second and fifth elements may each further include at the lower extremity thereof a generally horizontal flange. The flange on the second element may extend to the third element. The flange on the fifth element may extend to the fourth element.

In some forms of the invention the third and fourth elements may each further include a generally T-shaped element extending therefrom. The "top" of the T-shaped element is generally parallel to and spaced apart from the second and fifth elements. The "top" of one of the T-shaped elements and the horizontal distance between the "top" of the other T-shaped surface is substantially equal to the thickness of the associated wallboard.

Some forms the invention may include a trim panel which engages the "top" of one of the T-shaped elements and the third element. A second trim panel may also engage the "top" of the other of the T-shaped elements and the fourth element.

In accordance with some forms of the invention one of the T-shaped elements is integrally formed with the third element as a single channel. The other of the T-shaped elements may be formed with the fourth element as a single channel.

Some forms of the invention may include an upstanding flange surfaces which extend from the first element and are spaced apart to cooperate with the associated wallboard.

The apparatus may further include first and second vertical channel members each having generally parallel generally planar spaced elements which are spaced apart a distance substantially equal to the thickness of the associated wallboard.

The apparatus may also include in some forms of the invention trim panels cooperating with the first and second vertical channels.

BRIEF DESCRIPTION OF THE ACCOMPANYING DRAWING

DESCRIPTION OF THE PREFERRED EMBODIMENT

Figure 1:
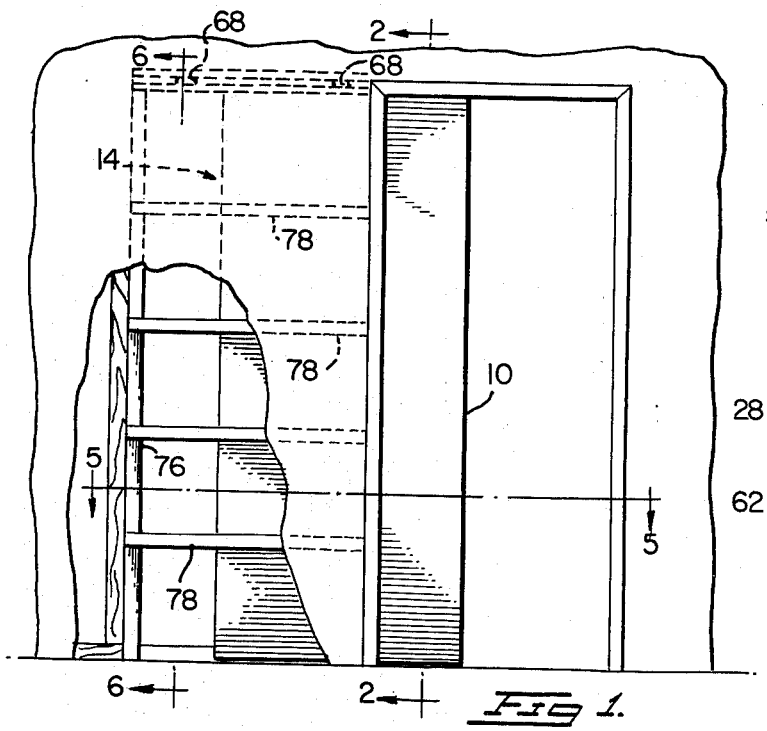
FIG. 1 is a front elevational view of a pocket door constructed in accordance with the invention.
Figure 2:
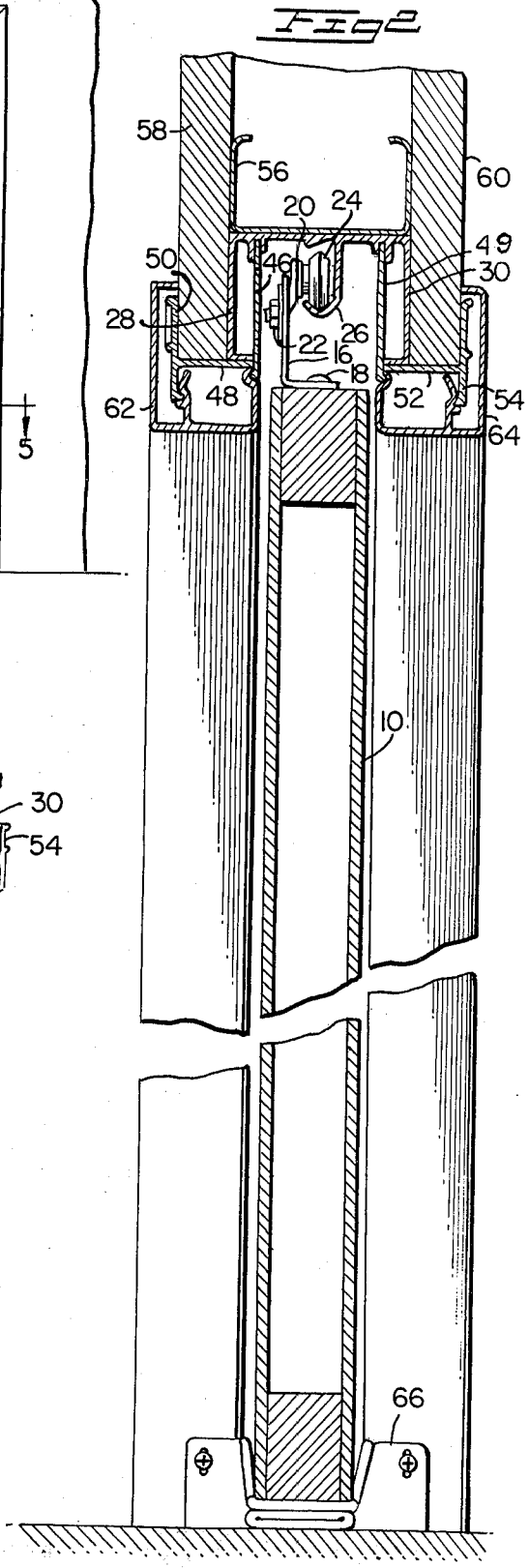
FIG. 2 is a sectional view taken through the lines 2—2 of FIG. 1.

Referring now to FIGS. 1, 2, 3, and 4 there is shown a door 10 which is slideable between a closed position in which it closes the doorway defined by frame 12 and an open position within a pocket generally designated by the numeral 14. At least two L-shaped brackets 16 are fixed by screws 18 (one each shown) to the top of door 10. An arm 20 is adjustably mounted on each bracket 16 by means of nut 22. A roller 24 is carried for rotation on arm 20. Each roller 24 is disposed in a generally J-shaped cross section channel 26.

In the embodiment illustrated a header structure includes the J-shaped channel 26 which is an integral part of a channel which includes a first element or upper surface 44, and four spaced generally planar parallel elements, these being a second element 28, a third element 46, a fourth element 49, and a fifth element 30. The generally planar elements 28, 30 each include an inwardly extending flange respectively identified by the numerals 32, 34. Ribs 36, 38, 40, 42 depend from the generally planar upper surface 44 of the channel as does the generally J-shaped cross section channel 26.

Figure 4:
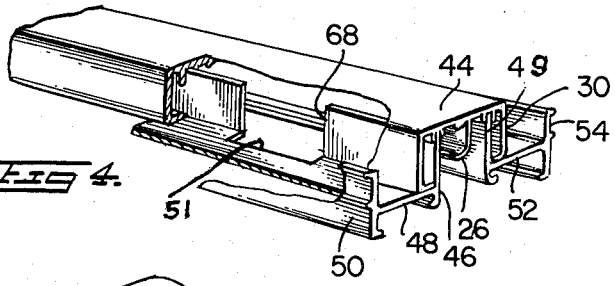
FIG. 4 is a perspective view of a portion of the apparatus shown in FIG. 2.
Figure 3:
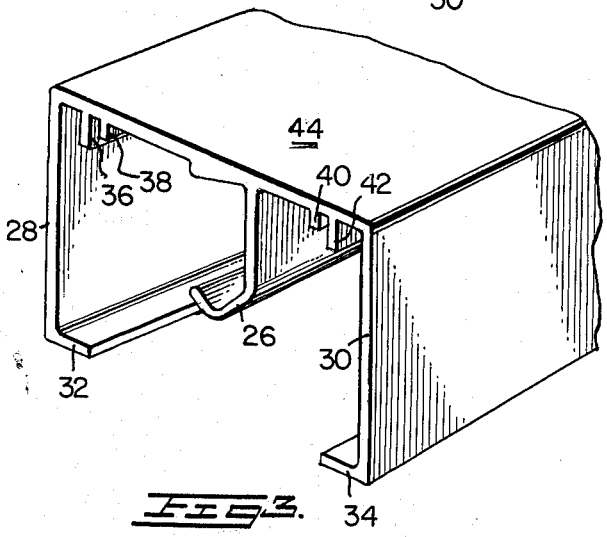
FIG. 3 is a perspective view of a portion of the roller support channel shown in FIG. 2.

A generally planar element 46 is disposed intermediate the ribs 36, 38 and extends away from the generally planar surface 44. The generally planar surface 46 abuts the edge of the flange 32. In one form of the invention the generally planar surface 46 is an integral part of a common channel which includes a T-shaped section which includes generally planar horizontal element 48 and generally planar vertical element 50. In a similar manner a generally planar horizontal element 52 is an integral part of the same channel as generally planar element 49 and generally planar vertical element 54. A support flange 56 is disposed on the upper generally planar surface 44. Pieces of wall board or panelling 58, 60 cooperate with the support flange 56 and the slot defined by respectively generally planar elements 28 and 50 and generally planar elements 30 and 54. Trim panel 62 engages ribs on generally planar surfaces 50 and 46. In a similar manner trim panel 64 engages ribs on generally planar surfaces 54 and 48. An adjustable guide 66 is provided at the bottom of the door 10. In accordance with a preferred form of the invention the generally planar element 46 is provided with two slots 68 as best seen in FIGS. 1 and 4. Axially aligned slots 51 are also provided in generally planar horizontal element 48.

Figure 5:
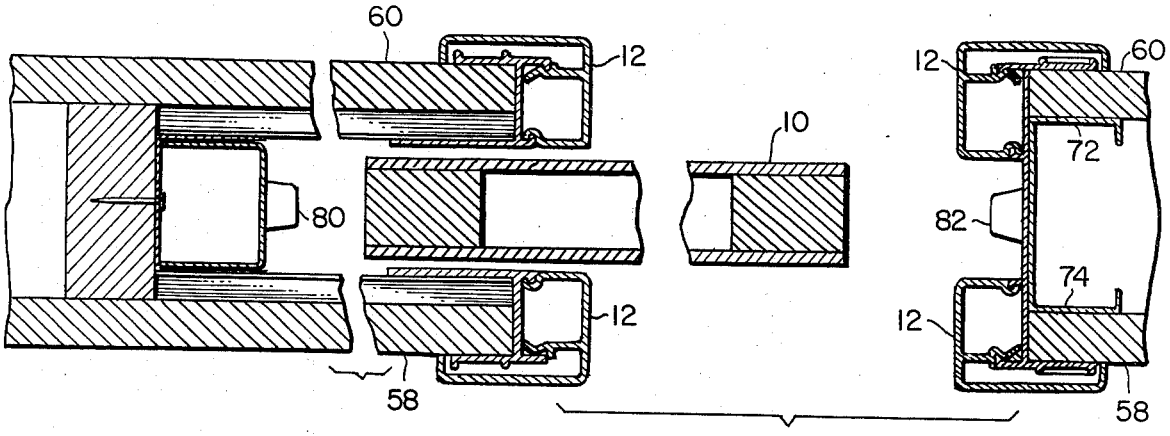
FIG. 5 is a sectional view taken through the lines 5—5 of FIG. 1.
Figure 6:
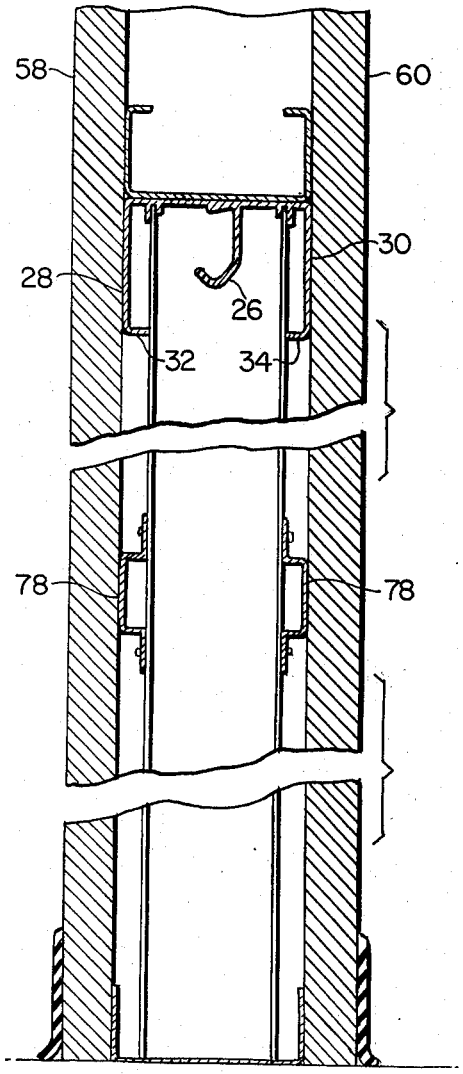
FIG. 6 is a sectional view taken through the lines 6—6 of FIG. 1.
Figure 7:
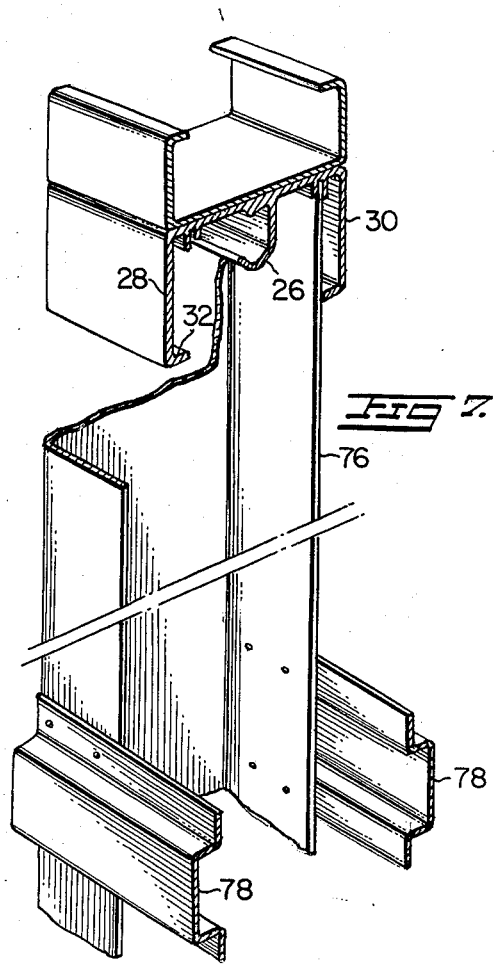
FIG. 7 is a perspective view of a portion of the pocket in accordance with the invention.

Referring now also to FIGS. 5, 6, and 7 the pocket door construction further includes vertical channels 72, 74 which each includes spaced generally parallel and planar members which cooperate with wallboard or panelling sections 58, 60.

The pocket construction includes steel sheet metal vertical element 76 and a plurality of steel sheet metal cross members 78. It will be understood that the number of horizontal members will vary in different constructions as will be apparent by comparison of FIGS. 6 and 1. Rubber bumpers 80 and 82 are disposed at the limits of travel of the door 10 to quietly constrain maximum movement.

During installation the door 10 is raised vertically and positioned axially along the J-shaped cross section element 26 so that the rollers 24 may pass into the openings 68, 68 and through the notches 51 in generally planar horizontal member 48. The door 10 is then lowered into cooperation with the J-shaped rail 26. Once lowered in this manner the door 10 will have little tendency to fall off of the J-shaped cross section element 26 since the dimensioning and location of the J-shaped element 26 and the generally planar element 46 will limit sideways movement of the door 10.

The apparatus in accordance with the invention will ordinarily be manufactured of steel except for the channel members which will customarily be extruded aluminum to minimize cost. The door frame constructed in this manner will have the additional advantage that it will be fireproof. In some forms of the invention the pocket doors may be constructed with pockets on each side of the given doorway. For some installations it will be desirable to provide trim only on one side such as in a closet doorway where the interior surfaces are less critical.

The invention has been described with reference to its illustrated preferred embodiment. Persons skilled in the art of constructing escape hatches may, upon exposure to the teachings herein, conceive variations in the mechanical development of the components therein. Such variations are deemed to be encompassed by the disclosure, the invention being delimited only by the appended claims.

The inventor claims:

1. A pocket door assembly including a header structure and comprising:

a first element which is generally planar and generally horizontal;

second, third, fourth and fifth elements, each of which is generally planar and extends downward from said first element in sequential generally parallel spaced relationship;

a roller support channel which is generally J-shaped, said roller support channel depending from said first element between said third and fourth elements;

said first through fifth elements forming portions of said header structure a door which includes a generally planar door and a plurality of rollers extending upwards beyond the top of said door, said rollers being spaced a predetermined distance apart, said rollers being dimensioned and configured for engagement with said roller support channel, said second and third elements including a plurality of slots spaced said predetermined distance apart; and said slots being dimensioned to allow passage of said rollers into said roller support channel.

2. The apparatus as described in claim 1 wherein:

said first element further includes first and second pairs of depending spaced ribs, said first pair of said depending spaced ribs engaging the sides of said third element, said second pair of ribs engaging the sides of said fourth element.

3. The apparatus as described in claim 2 wherein:

said first, second and fifth elements and said ribs are each part of a single channel.

4. The apparatus as described in claim 3 wherein;

said second and fifth elements each further include at the lower extremity thereof a generally horizontal flange, said flange on said second element extending to said third element, said flange on said fifth element extending to said fourth element.

5. The apparatus as described in claim 4 wherein:

said third and fourth elements each further include generally T-shaped elements extending laterally therefrom, the "top" of said T-shaped elements being generally parallel to and spaced from said second and fifth elements.

6. The apparatus as described in claim 5 further including a trim panel engaging said "top" of one of said T-shaped elements and said third element.

7. The apparatus as described in claim 6 further including a trim panel engaging the "top" of the other of said T-shaped elements and said fourth element.

8. The apparatus as described in claim 7 wherein:

one of said T-shaped elements is integrally formed with said third element as a single channel.

9. The apparatus as described in claim 8 wherein the other of said T-shaped elements is formed with said fourth element as a single channel.

10. The apparatus as described in claim 9 further including upstanding flange surfaces extending from said first element, said upstanding flange surfaces being spaced apart to cooperate with the associated wallboard.

11. The apparatus as described in claim 5, wherein:

the "top" of one of said T-shaped elements is positioned to abut an associated wallboard.

* * * * *